US005565828A

United States Patent [19]

Flohr

[11] Patent Number: 5,565,828

[45] Date of Patent: Oct. 15, 1996

[54] CIRCUIT BREAKER

[75] Inventor: Peter Flohr, Kahl, Germany

[73] Assignee: Heinrich Kopp AG, Kahl, Germany

[21] Appl. No.: 395,010

[22] Filed: Feb. 27, 1995

[30] Foreign Application Priority Data

Mar. 1, 1994 [DE] Germany ..... 44 06 670.8

[51] Int. Cl.[6] ..... H01H 9/00

[52] U.S. Cl. ..... 335/172; 335/177; 218/1

[58] Field of Search ..... 335/8–10, 35, 335/23–25, 167–176, 177–79; 218/1

[56] References Cited

U.S. PATENT DOCUMENTS

| | | | |
|---|---|---|---|
| 3,278,708 | 10/1966 | Casey et al. | 335/35 |
| 3,412,349 | 11/1968 | Laubenheimer | 335/8 |
| 3,786,380 | 1/1974 | Harper | 335/9 |
| 5,162,765 | 11/1992 | DiVincenzo et al. | 335/172 |

FOREIGN PATENT DOCUMENTS

| | | |
|---|---|---|
| 0014479 | 11/1984 | European Pat. Off. . |
| 2402092A1 | 7/1975 | Germany . |
| 2855040A1 | 7/1979 | Germany . |
| 3637275C1 | 5/1988 | Germany . |

*Primary Examiner*—Lincoln Donovan
*Attorney, Agent, or Firm*—Skjerven, Morrill, MacPherson, Franklin & Friel; Norman R. Klivans

[57] ABSTRACT

A circuit breaker with an input side and an output side for connecting and disconnecting conductors in an electrical circuit comprising a magnetic breaker device which acts on a latching mechanism unit for opening a contacting device in case of overload, an arc-quenching means being connected to said magnetic breaker device, whereat said magnetic breaker device comprises two parallel connected coils.

8 Claims, 4 Drawing Sheets

CIRCUIT BREAKER

Figure 1:
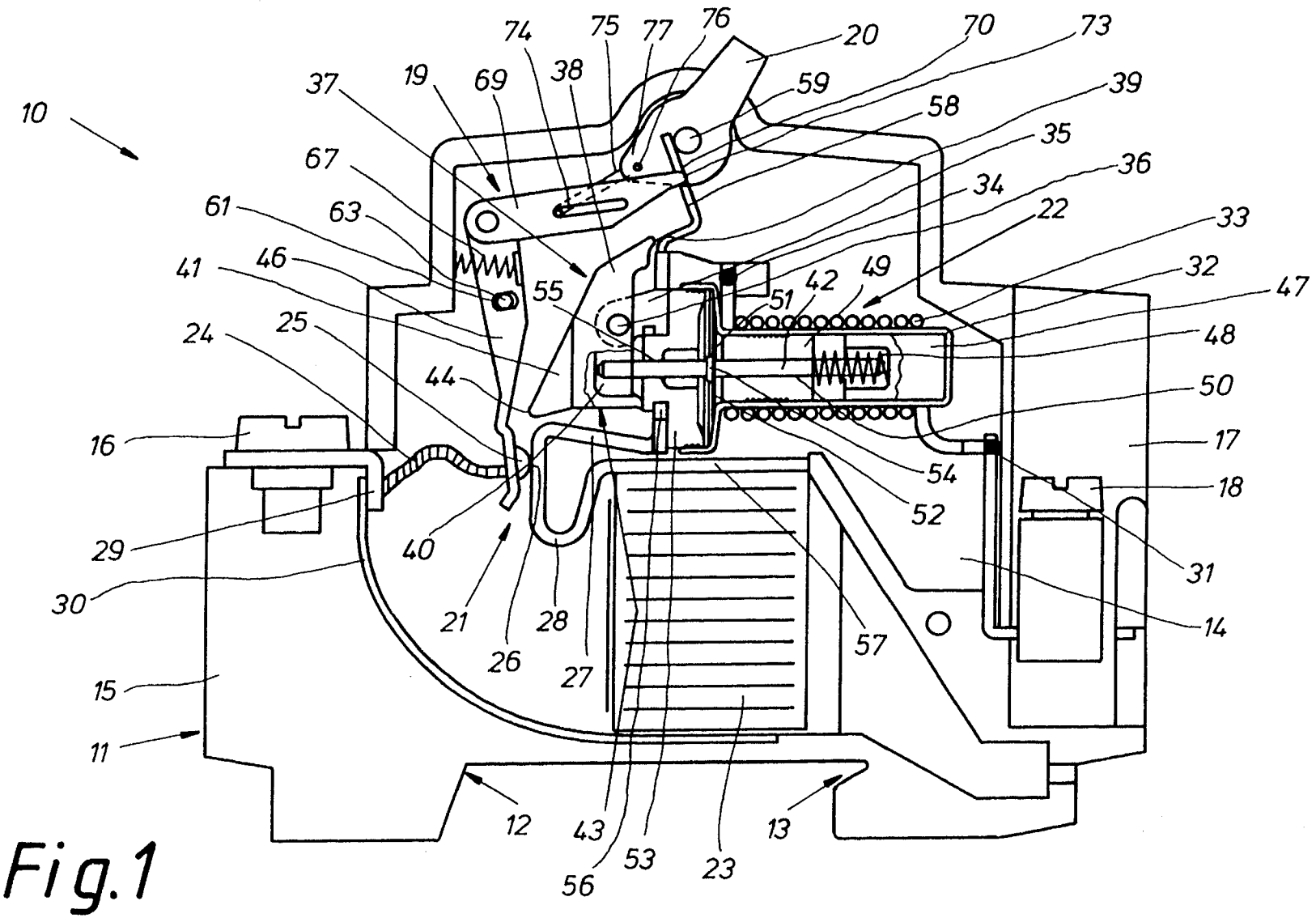

The invention relates to a circuit breaker with an input side and an output side for connecting and disconnecting conductors in an electrical circuit.

A circuit breaker having a magnetic breaker which is designed up to approximately 50 A is known from the EP 144 799 B1. Such a circuit breaker is intended to be miniaturized as far as possible in spite of increased power.

Circuit breakers are provided according to the norm up to a nominal current of 125 A. Since for the use of circuit breakers norm distances or norm pitches (e.g. 18 mm) are predetermined respectively and also switching means with higher nominal currents have to be put in the bus bar combine, the geometric dimensions and linkage dimensions of circuit breakers with higher nominal currents have to be congruent to the known circuit breakers with smaller nominal currents. Because of economical reasons, it would be wrong to develop separate realizations for current breakers with higher nominal currents, since the range of application of such current breakers is naturally smaller than for current breakers with smaller nominal currents, especially since new tools and other manufacturing means would be necessary.

The invention has the object to provide a circuit breaker for higher nominal currents with a simple structure which is miniaturized as far as possible and which can be manufactured avoiding special constructions.

This object is achieved by a circuit breaker with an input side and an output side for connecting and disconnecting conductors in an electrical circuit comprising a magnetic breaker device which acts on a latching mechanism unit for opening a contacting device in case of overload, an arc-quenching means being connected to said magnetic breaker device, wherein said magnetic breaker device (22) comprises two parallel connected coils (33*a*, 33*b*).

Further embodiments of the present invention are characterized by the subclaims.

The present invention provides a circuit breaker comprising according to a preferred embodiment a magnetic break means which consists of two parallel connected magnetic breakers, i.e. the coils of the magnetic breakers are connected parallel to each other.

Contrary to two parallel connected circuit breakers being designed up to 50 A respectively and resulting thereby theoretically a 100 Ampere apparatus by means of the parallel connection of the coils of the magnetic breaker means, a symmetric current distribution is ensured according to the present invention. The simple parallel connection of two circuit breakers provides in comparison to the solution according to the present invention no symmetric current distribution between the two parallel connected circuit breakers the parallel connection of which would be effected with regard to the terminals.

According to the invention, the two coils of the magnetic breaker means are parallel connected additionally to the parallel connection of the two terminals by providing an inner connection. By means of this additional inner connection or compensating line it is guaranteed that the current is symmetrically divided through the two coils and that not through different contact resistances at the contacts, at welding and connection points etc. a different current flow exists over the two branches of the parallel connection.

According to the invention, preferably stool clips are provided as terminals which permit by means of two screws respectively the connection of conductors up to 50 $mm^2$ having several wires. If for the distance of the two attachment screws the nominal pitch of, for example, 18 mm is kept, it is possible without any further effort to install such current breakers for high nominal currents in conventional bus bars combined with switching devices having smaller nominal currents.

The coil of the circuit breaker according to the invention is preferably used as a magnetic breaker as well as a heating for the thermal breaker, consequently resulting in that the bimetal itself is not flown through by a current.

The circuit breaker according to the invention is used for a nominal current of >63 A, for example 100 A, and consists according to a preferred embodiment of two 50 A circuit breakers accordingly being applied to by two times 50 A so that the 100 A circuit breaker according to the invention shows the same behavior as a 50 A circuit breaker.

Figure 2:
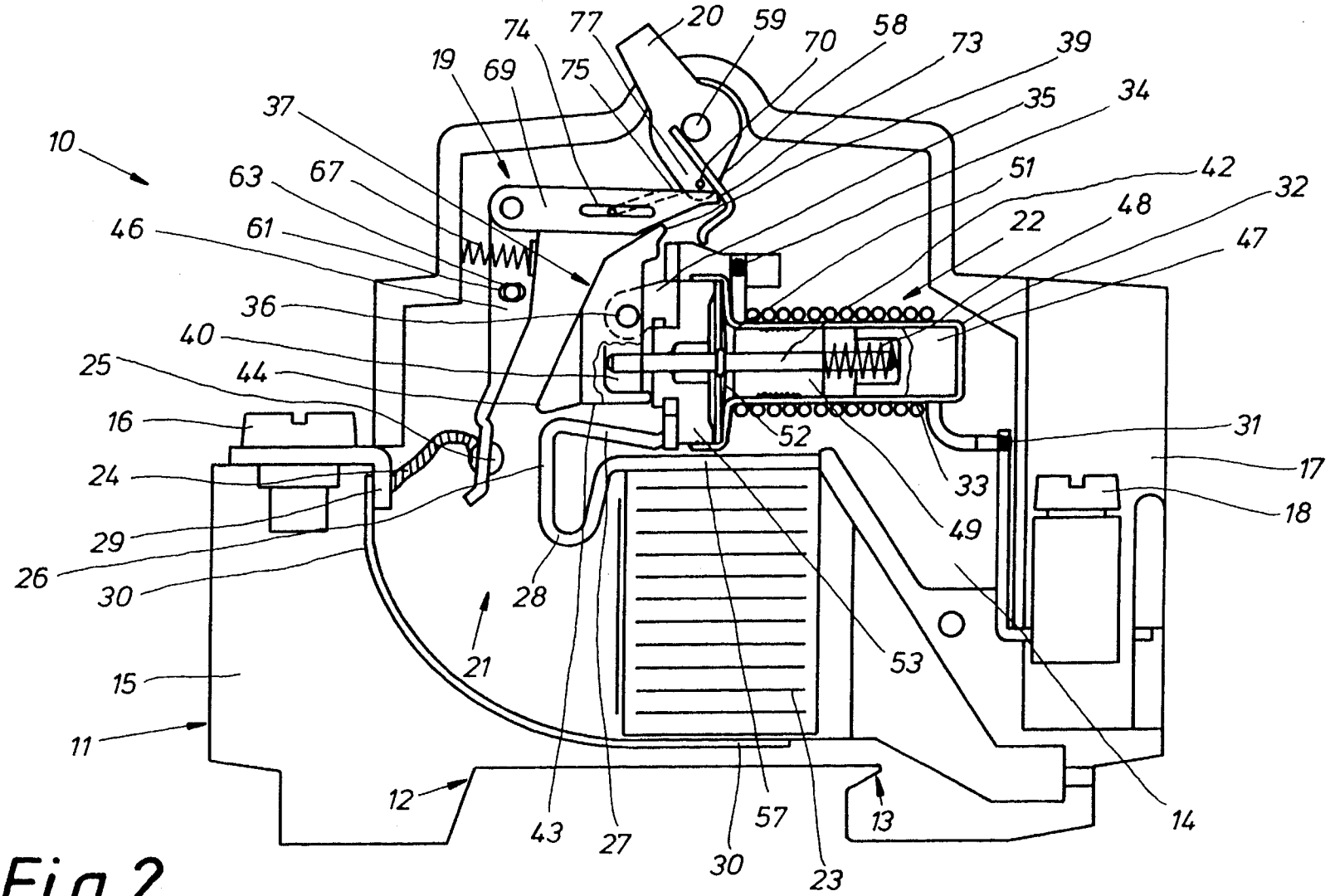
Figure 3:
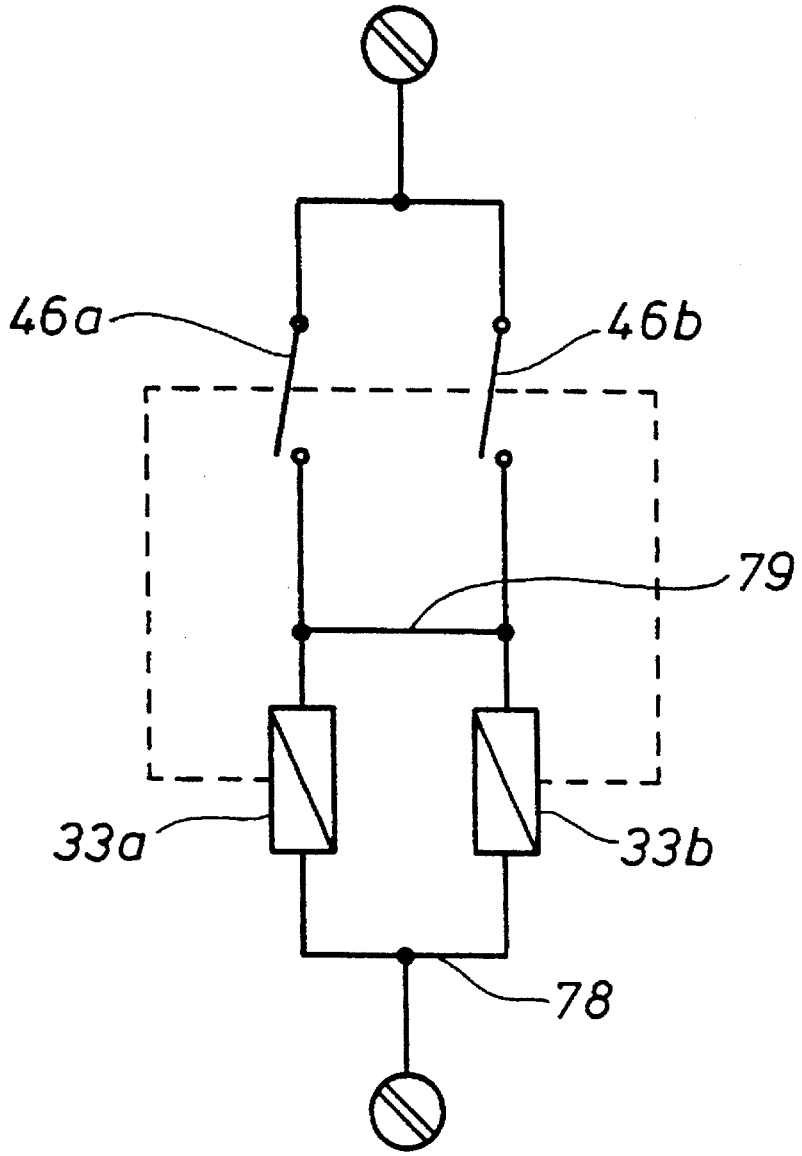
Figure 4:
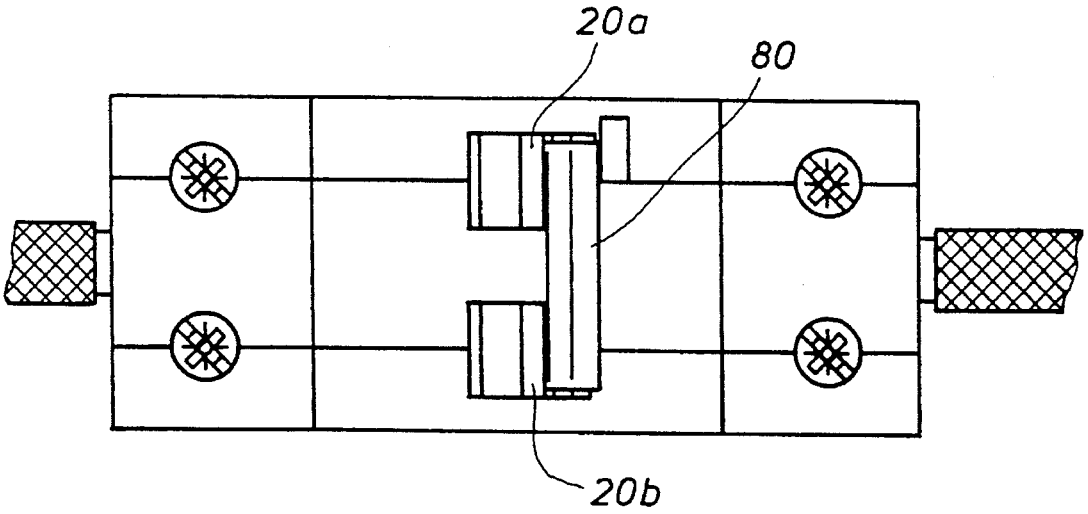
Figure 5:
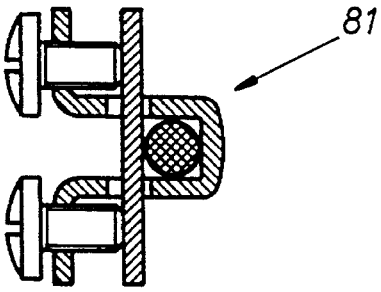

Subsequently, the power circuit according to the invention is described by drawings for the explanation of further features, wherein:

FIG. 1 and 2 show a preferred embodiment of the circuit breaker,

FIG. 3 a circuit diagram of the coils for the magnetic breaker means according to the invention, and FIG. 4 a plan view of a circuit breaker according to the invention, and FIG. 5 a sectional view of a stool clip.

FIG. 1 shows a preferred embodiment of a circuit breaker 10, which comprises a narrow housing 11 made of an insulating plastic and on its rear side, at the bottom in FIG. 1 and 2, is provided with receptacles 12 and 13 for being fitted on a conventional mounting rail. The housing 11 comprises an interior chamber 14, a top portion 15, which is provided with a terminal 16, and a bottom portion 17, which is provided with a terminal 18.

A latching mechanism 19, an overcurrent trip 22, and high-duty arc-quenching means 23 are fixedly mounted in the interior chamber 14. The latching mechanism 19 comprises a movable switching toggle 20, which protrudes out of the housing 11, and contacting means 21.

The terminal 16 is connected by a movable flexible lead 24 to the movable contact 25 of the contacting means 21. The complementary stationary contact 26 of the contacting means 21 consists of a portion of a solid conductor 27, which has a thickness of about 1.2 mm and extends from the overcurrent trip 22 via the stationary contact 26 and a loop 28 to the high-duty arc-quenching means 23. An arcuate arc-guiding plate 30 extends between an angled portion 29 of the terminal 16 and a rear portion, which is close to the arc-quenching means 23. The flexible lead 24 is secured to the angled portion 16.

The terminal 18 is connected by a weld 31 to the overcurrent trip 22. More specifically, the overcurrent trip 22 comprises a rotationally symmetrical, hollow cylindrical carrying body 32, which has a high thermal conductivity and comprises a portion, on which a coil 33 is wound in tight contact therewith. One end of the coil 33 is connected by the soldered joint 31 to the terminal 18. The other end of the coil 33 is connected via a soldered joint 34 and a mounting plate 35 to the conductor 27 in the forward portion of the carrying body 32. The mounting plate 35 serves to fix the carrying body 32 in the interior chamber 14 of the housing 11 by means of a pin 36, which serves also as a pivot for a two-armed lever 37.

The two-armed lever 37 comprises a first arm 38, that is provided with an unlatching nose 39, and is also integrally formed with an abutment portion 40, over which the mounting plate 35 extends, and a second arm 41, which is engageable by a plunger 42 of the overcurrent trip 22 within the abutment portion 40. The second arm 41 is integrally formed on its rear side (on the underside in FIG. 1 and 2)

with a baffle wall 43 and with a nose 44, which serves to strike open the movable contact 25, which is provided on a first arm 45 of a two-armed contact-carrying lever 46.

The carrying body 32 of the overcurrent trip 22 contains a movable armature 47, which serves to actuate the plunger 42 and by means of a spring 48 that is guided by the plunger 42 is biased away from a core 49 for guiding the plunger. The core 49 has a central bore 50, in which the plunger 42 is guided. The core 49 for guiding the plunger as well as the armature 47 for actuating the plunger are rotationally symmetrical. Whereas the armature 47 for actuating the plunger is movable, the core 49 for guiding the plunger is fixedly mounted in the cylindrical interior chamber of the hollow carrying body 32.

A bimetal-containing chamber 51 is disposed in front of the core 49 for guiding the plunger, in FIG. 1 and 2 on the left of said core. The bimetal-containing chamber 51 contains a snap-action bimetal disk 52, which is held by a disklike element 53 in an enlarged portion of the carrying body 32. The bimetal disk 52 has a central bore, which is only slightly larger in diameter than the plunger 42, so that a disk-engaging protection 54 integrally formed with the plunger 42 can be engaged by the bimetal disk 52 for moving the plunger 42 to effect a thermally induced release. The disklike element 53 has also a through opening 55 for receiving the plunger 42, which in its initial position is clear of the two-armed lever but protrudes into the abutment portion 40, which is integrally formed with the lever 37. The conductor 27 is secured in a receptacle 56, that is provided on the disklike element 53, and the conductor 27 is conductively connected to the other end of the coil. The looped portion 28 of the conductor 27 is succeeded by an arc-guiding straight portion 57, which is parallel to the front side of the arc-quenching means 23.

The unlatching nose 39 of the two-armed lever 37 serves to engage an angled lever 58, which is a functional part of the latching mechanism 19. The tripping lever 58 is pivoted on a pivot 59, which is fixed to the housing and which constitutes also a pivot for the switching toggle 20.

The latching mechanism 19 comprises also the above-mentioned two-armed contact-carrying lever 46, which has a slot 61, which extends transversely to the longitudinal direction of the contact-carrying lever 46. A pivot 63 is secured to the housing and extends through the slot 61 and serves to guide the contact-carrying lever 46. The contact-carrying lever 46 bears on the housing 11 by means of a spring 67, which biases the contact-carrying lever 46 in the clockwise sense as shown on the drawings. The contact-carrying lever 46 is pivoted to an intermediate lever 69, which has a noselike free end portion 73, which is latched by a stop 70 of the tripping lever 58. The intermediate lever 69 is formed with a slot 74, which receives one end of a U-shaped member 75, which at its other end extends into a bore 76 in a projection 77 that is integrally formed with the switching toggle 20.

When a high overcurrent results in a tripping excitation of the coil 33 or when a relatively low overcurrent sustained for a substantial time results in a temperature rise of the carrying body 32 owing to the heat-conducting contact between the coil 33, which is wound on the carrying body 32, and the latter, and said temperature rise is transmitted to the snap-action bimetal disk, the plunger 42 will be actuated to move Out of its initial position shown in FIG. 1. This is effected either electromagnetically or by the snap action of the bimetal disk 52. As a result, the plunger 42 strikes against the second arm 41 of the two-armed lever 37, and the nose 44 strikes against the first arm 45 of the contact-carrying lever 46 so that the movable contact 44 of the contacting means 21 is struck open. Because the two-armed lever 37 is made of an insulating material which under the action of an electric arc releases a gas and particularly consists of lucite, gas will intermittently be released and will desirably urge the electric arc which has been generated to the arc-quenching means 23. When the electric arc impinges on the baffle wall 43 of the lever 37, that baffle wall 43 will deflect the electric arc into the intended direction.

At the same time, the unlatching nose 39 of the two-armed lever 37 strikes against the tripping lever 58 to unlatch the latter from the intermediate lever 69 and the pressure applied by the spring 67 will then turn the contact-carrying lever 45 in the clockwise sense. By means of the intermediate lever 69 the U-shaped member 75 is then moved to the right so that the switching toggle 20 is rotated in a counterclockwise sense to its break position and the lever 46 which carries the movable contact is held in its open position. In that position the contacting means 21 will reliably be held open by the latching mechanism 19.

FIG. 2 shows the circuit breaker 10, in which the contacting means 21 are reliably held open after an electromagnetic or thermoelectric release.

According to a preferred embodiment of the circuit breaker according to the present invention, a double formation of the components being described in combination with FIG. 1 and 2 is provided for a nominal current of e.g. 100 A, i.e. all above-described components are provided twice and therefore also two overcurrent trips 22 are provided which are parallel connected in a way still to be described below. The terminals 16 of the two units are additionally parallel connected as will be described below.

Additionally, according to the present invention, the two coils 33 are connected with each other on the input side as well as on the output side to guarantee a symmetric current distribution.

In FIG. 3, the two coils are indicated with **33*a*, 33*b* which are respectively assigned to the releasing mechanism or overcurrent trip 22 being described respectively in connection with FIG. 1 and 2. The contact or contact-carrying lever being assigned to each coil 33*a*, 33*b* is indicated with 46*a*, 46*b* in FIG. 3, respectively. Consequently, according to FIG. 3, the contact-carrying lever 46*a* is opened through a plunger 42 being moved by means of the coil 33*a* and the contact-carrying lever 46*b* through the plunger 42 being actuated by the coil 33*b*. This means that the contact-carrying levers 46*a*, 46*b* are not mechanically coupled with each other or have to be coupled with each other. If an overcurrent flows through the coil 33*a*, the contact-carrying lever 46*a*is opened. If an overcurrent continues to flow, the contact-carrying lever 46*b* is also immediately opened within a very short period of time by means of the current flow which flows then exclusively through the coil 33*b***.

The two coils **33*a*, 33*b* are on the output side electrically coupled to each other through a connection 79**, and on the input side the two coils are also directly coupled to each other through a corresponding electric connection.

FIG. 4 shows a view of the circuit breaker according to the present invention wherein the two switch handles indicated with **20*a*, 20*b* in FIG. 4 are coupled to each other through a connecting handle 80. Thus, a manual closing of both contact-carrying levers 46*a*, 46*b*** after effected release caused by overcurrent is ensured as well as manually opening said contact-carrying levers.

According to a preferred embodiment of the circuit breaker according to the present invention, the connection of the conductor on the input side as well as on the output side is effected with the help of stool clips being shown schematically in FIG. 5 and which therefore are provided on the input side as well as on the output side of the circuit breaker.

The stool clip 81 according to FIG. 5 is situated preferably on the left as well as on the right side of the circuit breaker shown in FIG. 4 whereat the stool clip represents respectively the connection to the terminals being indicated with 16 and respectively 18 in FIG. 1 and 2.

In the circuit breaker according to the present invention, the coil 33*a*, 33*b* is used as a magnetic breaker as well as a heating for the thermal breaker which results in that the mounted bimetal in form of a bimetal disk is not flown through by a current. The additional parallel connection of the coils 33*a*, 33*b*, namely on the input side of the coils as well as on the output side, as shown in FIG. 3, provides additionally to the parallel connection of the two units by means of the stool clips 81 according to FIG. 5 a symmetric current distribution and avoids difficulties due to different production-induced inner resistances.

Principally, the current breaker according to the invention uses the employment of two identical units with the proviso that the two coils of the two units are respectively connected with each other on the input side as well as on the output side. Besides a double-T housing for receiving the circuit breaker according to the present invention and the bigger terminal in form of the stool clip according to FIG. 5 no further components are necessary in comparison to conventional circuit breakers of this kind.

Although the present invention is disclosed in conjunction with a preferred embodiment of a circuit breaker, this principle can also be applied to other circuit breakers, for example by employing of respectively two circuit breaker units, as described in the DE 39 15 127 C1. According to the present invention, such circuit breaker constructions are preferred wherein the thermal release is ensured without bimetal components being flown through by a current.

I claim:

1. A circuit breaker with an input side and an output side for connecting and disconnecting conductors in an electrical circuit, comprising:

a magnetic breaker device which acts on a latching mechanism unit for opening a contacting device in case of overload, and an arc-quencher connected to said magnetic breaker device, wherein said magnetic breaker device includes two parallel connected coils.

2. The circuit breaker according to claim 1, wherein said latching mechanism unit includes two latching mechanisms which are respectively assigned to a contacting means, wherein each of said coils is connected to said arc-quencher.

3. The circuit breaker according to claim 1, wherein said input side and said output side are each provided with a stool clip for connecting said conductors.

4. The circuit breaker according to claim 1, wherein said latching mechanism unit comprises switch handles with a connecting handle.

5. A circuit breaker with an input side and an output side for connecting and disconnecting conductors in an electrical circuit, comprising:

a magnetic breaker device which acts on a latching mechanism unit for opening a contacting device in case of overload, and an arc-quencher connected to said magnetic breaker device, wherein said magnetic breaker device includes two coils which are connected electrically in parallel between said input side and said output side, even when said circuit breaker is in a state where said conductors are disconnected, wherein a moveable plunger is disposed within each of said coils, and wherein said plunger is driven by a snap-action bimetal disk, said snap-action bimetal disk having a central through-bore for said plunger and being arranged outside said electrical circuit.

6. The circuit breaker according to claim 1, wherein said two coils are directly connected together on said output side by a compensating line.

7. The circuit breaker according to claim 5, wherein said two coils are directly connected together on said output side by a compensating line.

8. A circuit breaker with an input side and an output side for connecting and disconnecting conductors in an electrical circuit, comprising:

a magnetic breaker device which acts on a latching mechanism unit for opening a contacting device in case of overload, and an arc-quencher connected to said magnetic breaker device, wherein said magnetic breaker device includes two coils, said two coils being connected electrically in parallel between said input side and said output side, even when said circuit breaker is in a state where said conductors are disconnected.

* * * * *